US009453672B2

(12) United States Patent
Becke et al.

(10) Patent No.: US 9,453,672 B2
(45) Date of Patent: Sep. 27, 2016

(54) DOMESTIC REFRIGERATION APPLIANCE WITH A DISPLAY FOR A CONTAINER LID

(71) Applicant: BSH Hausgeräte GmbH, München (DE)

(72) Inventors: Christoph Becke, Grosskarolinenfeld (DE); Max Eicher, München (DE); Swetlana Gorodezki, München (DE); Maike Kirschbaum, München (DE); Ralph Staud, München (DE); Thomas Tischer, Haar (DE)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/647,025

(22) PCT Filed: Nov. 15, 2013

(86) PCT No.: PCT/EP2013/073950

§ 371 (c)(1),
(2) Date: May 22, 2015

(87) PCT Pub. No.: WO2014/079781

PCT Pub. Date: May 30, 2014

(65) Prior Publication Data

US 2015/0300724 A1 Oct. 22, 2015

(30) Foreign Application Priority Data

Nov. 23, 2012 (DE) ..... 10 2012 221 499

(51) Int. Cl.
*F25D 23/02* (2006.01)
*F25D 25/02* (2006.01)

(52) U.S. Cl.
CPC ..... *F25D 23/028* (2013.01); *F25D 23/026* (2013.01); *F25D 25/025* (2013.01); *F25D 2317/04131* (2013.01); *F25D 2400/36* (2013.01)

(58) Field of Classification Search
CPC ..... F25D 25/00; F25D 25/02; F25D 25/025; F25D 29/00; F25D 2325/00; F25D 2400/18; F25D 2400/36; F25D 2317/04131; F25D 2317/0413; F25D 23/028; F25D 23/026; F25D 23/025; A47B 2088/011; A47B 2210/08; A47B 2210/17; A47B 2210/175; H01H 13/72; G05G 1/015; G05G 1/02; G05G 1/025; G05G 5/08; G05G 11/00
USPC ..... 200/5 B, 5 E, 50.32, 50.33, 50.36
See application file for complete search history.

(56) References Cited

U.S. PATENT DOCUMENTS 855,962 A * 6/1907 Mitchell et al. ..... F25D 3/02 177/143
2,129,474 A * 9/1938 Money ..... 62/131

(Continued)

FOREIGN PATENT DOCUMENTS

CN 1714264 A 12/2005
CN 101203721 A 6/2008

(Continued)

OTHER PUBLICATIONS

International Search Report for PCT/EP2013/073950, mailed Feb. 28, 2014, 4 pages.

(Continued)

*Primary Examiner* — Andrew Roersma
(74) *Attorney, Agent, or Firm* — Nixon & Vanderhye P.C.

(57) ABSTRACT

A domestic refrigeration appliance has a heat-insulating inner container which is designed to delimit at least one storage space for refrigerated goods, a refrigerated goods container mounted in the inner container, which goods container has an opening accessible from the top, and a container lid which is mounted in the inner container such that a movement carried out by a manual actuator is converted into a movement of the container lid for opening and closing the opening of the refrigerated goods container. A display is connected to the actuator, which display is designed to display, in a first position of the actuator in which the container lid is moved into a cover position so as to open the opening of the refrigerated goods container, an item of information characterizing the open position, and in a second position of the actuator in which the container lid is moved into a cover position so as to close the opening of the refrigerated goods container, an item of information characterizing the closed position.

12 Claims, 6 Drawing Sheets

(56) References Cited

U.S. PATENT DOCUMENTS

| | | | | | |
|---|---|---|---|---|---|
| 2,450,823 | A * | 10/1948 | Bauman | F25D 29/00 | 200/36 |
| 2,613,630 | A * | 10/1952 | McNairy | H05B 3/342 | 116/102 |
| 3,364,694 | A * | 1/1968 | Cohen et al. | 62/265 | |
| 4,205,533 | A * | 6/1980 | Sterling | 62/131 | |
| 4,250,719 | A * | 2/1981 | Grimm | F25D 17/045 | 62/382 |
| 4,539,860 | A * | 9/1985 | Johnston | G05G 5/08 | 200/5 EA |
| 4,557,118 | A | 12/1985 | Pink et al. | | |
| 4,745,775 | A * | 5/1988 | Bussan et al. | 62/382 | |
| 4,850,206 | A | 7/1989 | Larsen | | |
| 5,437,503 | A | 8/1995 | Baker et al. | | |
| 5,540,492 | A | 7/1996 | Dasher et al. | | |
| 6,813,896 | B1 * | 11/2004 | Janke et al. | 62/126 | |
| 6,837,068 | B2 * | 1/2005 | Wood | A47B 88/10 | 312/402 |
| 7,624,593 | B2 * | 12/2009 | Lee | F25D 17/045 | 62/408 |
| 2003/0222044 | A1 * | 12/2003 | Maritan et al. | 211/153 | |
| 2007/0097042 | A1 * | 5/2007 | Bauer | F25D 29/00 | 345/82 |
| 2007/0151836 | A1 * | 7/2007 | Oh | 200/314 | |
| 2009/0033188 | A1 * | 2/2009 | Becke | F25D 25/02 | 312/404 |
| 2009/0050461 | A1 * | 2/2009 | Alo | H05K 7/1494 | 200/5 B |
| 2009/0199587 | A1 * | 8/2009 | Matthews | F25D 17/042 | 62/448 |
| 2012/0125314 | A1 * | 5/2012 | Alonso Esteban | C03C 17/36 | 126/211 |
| 2012/0146477 | A1 * | 6/2012 | Bischofberger et al. | 312/404 | |

FOREIGN PATENT DOCUMENTS

| | | | | |
|---|---|---|---|---|
| CN | 102625898 | A | 8/2012 | |
| CN | 102628633 | A | 8/2012 | |
| CN | 102667374 | A | 9/2012 | |
| DE | 3438593 | A1 * | 1/1986 | G05G 1/02 |
| DE | 102007060834 | A1 * | 6/2009 | F25D 25/00 |
| EP | 1 586 253 | | 10/2005 | |
| EP | 2 273 219 | | 1/2011 | |
| EP | 2662648 | A1 * | 11/2013 | F25D 17/045 |
| FR | 2299676 | A1 * | 8/1976 | G05G 1/015 |
| GB | 1 402 839 | | 8/1975 | |
| JP | 04110586 | A * | 4/1992 | F25D 23/00 |
| JP | H 064584 | U * | 1/1994 | F25D 23/00 |
| JP | 7-71865 | A | 3/1995 | |
| WO | WO 98/26241 | | 6/1998 | |
| WO | WO 0021136 | A1 * | 4/2000 | F24F 11/00 |

OTHER PUBLICATIONS

Written Opinion (non-English language) of the ISA for PCT/EP2013/073950, mailed Feb. 28, 2014, 5 pages.

* cited by examiner

DOMESTIC REFRIGERATION APPLIANCE WITH A DISPLAY FOR A CONTAINER LID

This application is the U.S. national phase of International Application No. PCT/EP2013/073950 filed 15 Nov. 2013 which designated the U.S. and claims priority to DE Patent Application No. 10 2012 221 499.2 filed 23 Nov. 2012, the entire contents of each of which are hereby incorporated by reference.

The invention relates to a domestic refrigeration appliance having a heat-insulating inner container which is designed to delimit at least one storage space for refrigerated goods, a refrigerated goods container mounted in the inner container, which refrigerated goods container has an opening accessible from the top, and a container lid which is mounted in the inner container such that a movement carried out by a manual actuator is converted into a movement of the container lid for opening and closing the opening of the refrigerated goods container.

DE 10 2009 029 141 A1 describes a refrigeration appliance, especially a domestic refrigeration appliance, with a storage compartment and a container divided from the storage compartment, wherein at least one closure part of the container is able to be adjusted between an open and a closed position, and wherein the container, in the open position of the closure part, communicates with a high-pressure area and a low-pressure area of the storage compartment. In this case a slider able to be guided with a horizontal movement is provided, wherein one of the cover or the slider has an angled guide contour and the other has an element interacting with the guide contour and able to be moved relative to the guide contour.

The object of the invention is to specify a domestic refrigeration appliance in which a display of the manual actuation of a container lid is improved.

The object of the invention is achieved by a domestic refrigeration appliance having a heat-insulating inner container which is embodied to delimit at least one storage space for refrigerated goods, a refrigerated goods container mounted in the inner container which has an opening accessible from the top, and a container lid which is mounted in the inner container such that a movement carried out by a manual actuator is converted into a movement of the container lid for opening and closing the opening of the refrigerated goods container, further having display means coupled to the actuator which are embodied, in a first position of the actuator in which the container lid is moved into a lid position opening the opening of the refrigerated goods container, to display information identifying the opening position and in a second position of the actuator in which the container lid is moved into a lid position closing the opening of the refrigerated goods container, to display information identifying the closed position.

The information can for example be a label, such as "open", "closed", "wet", or "dry". As an alternative the label can describe a preferred refrigerated goods to be stored, such as for example "vegetables", "fish", "meat" or "cheese". As an alternative or in addition the information can also be a graphical representation, a symbol, a letter, such as A or B, or a number. The display means is inventively embodied to display precisely that information that corresponds to the current lid position of the container lid. The refrigerated goods container is ventilated more or less, as a function of the lid position, so that a specific temperature and/or moisture is set as a function of the ventilation. Depending on the temperature and/or moisture, a climate is produced in the refrigerated goods container which is optimum for specific types of refrigerated goods.

An actuation, i.e. a change of state of the manual actuator can especially always be carried out in the same direction, for example by pressing. A mechanical facility relating to said actuation can for example be embodied in a similar way to a mechanism known to the person skilled in the art, such as is used in a ballpoint pen for example.

Since, particularly in what are known as no-frost domestic refrigeration appliances, moisture tends to be removed from the air, foodstuffs which need a certain moisture for retaining the nutritional value, the taste or the structure dry out more quickly in an undesirable manner. In order to prevent this these foodstuffs are stored in a separate refrigerated goods container, such as a vegetable drawer for example, in order to isolate them from the regular air circulation. Since however different foodstuffs need different air humidities to maintain optimum freshness, a part of the air humidity arising through condensation transpiration of the refrigerated goods should also be taken away again. In order to make this possible in accordance with the invention a manually-controllable, especially circulating complete opening of the refrigerated goods container is to be achieved.

The refrigerated goods container can be closed off with a container lid which, by pushing it in a direction for example over sloping surfaces in the vertical and horizontal direction, can be opened or closed. Under a fixed glass plate the container lid can be supported with lateral frame rails on guide elements. A groove or a recess or a control curve can be made the container lid for example. A manual actuator is then located on the fixed glass plate or on a frame, which engages for example with a cam into the recess or control curve in the container lid. It is also possible to swap control curve and cam or actuation stud. In accordance with the slope of the guide groove or the shape of the recess, on actuation of the actuator the container lid is moved horizontally and vertically. When this is done a surrounding gap is produced between container lid and refrigerated goods container.

The storage facility which is embodied to convert a movement initiated by a manual actuator for opening and closing the opening of the refrigerated goods container can be embodied in accordance with DE 10 2009 029 141 A1 for example.

In a first variant the manual actuator can be embodied as a press button i.e. can have two switching states. In this case, in a first position of the press button an actuation surface of the press button can protrude further than in a second position. In these two positions the actuation surface is unactuated, i.e. a user's finger is not touching it or pressing it. In the first position of the press button the container lid can be located in the first position. In the second position of the press button the container lid can be located in the second position. Thus two container lid positions can be realized with such a press button.

The display means can have a mask which bears the information identifying the open position and/or the closed position in the form of a mask cutout, wherein the display means, especially the actuator has a display section which in the first position of the actuator allows the information of the mask identifying the open position to stand out optically and/or in the second position of the actuator allows the information of the mask identifying the closed position to stand out optically.

The mask can be embodied as a film for example, which is glued or laminated onto the underside of a glass plate for example.

The actuator can have a display section which in the first position of the actuator allows the information of the mask identifying the closed position to recede optically and/or in the second position of the actuator, allows the information of the mask identifying the open position to recede optically.

In a position of a first actuation surface of the actuator a second color surface section of the display section attached to a wall section can come to rest precisely below a mask section of the mask, so that because of the color design of the second color surface section and of the mask, information to be displayed stands out optically. In this case for example the second color surface section can have a different color from the mask, especially a high-contrast color.

In another setting of the first actuation surface for example a first color surface section of the display section attached to the wall section can come to rest precisely below the mask section of the mask so that, because of the color design of the first colored surface section and of the mask, the information does not stand out optically i.e. recedes optically. In this case for example the first color surface section can have the same color and/or the same contrast as the mask.

In one design the display section can have a first color surface section at least approximately matching the mask in color, especially identical to it, and can have a second color section which differs in color from the mask, especially stands out from the mask in a high-contrast manner.

Each of the two color surface sections can have a suitable color for the purpose. Black and white is also understood as colors in this case. The color surface sections can also have correspondingly appropriate surface properties, i.e. for example rough, smooth, matt, glossy, transparent and/or self-illuminated. The information is thus optically highlighted or not highlighted as a function of which of the two color surface sections is located precisely below the cutout of the mask. In such cases the colors of the color surface sections are to be matched accordingly to the color of the mask.

In one form of embodiment the mask can be attached to a transparent shelf disposed above the refrigerated goods container, especially to a glass plate.

The mask in this case can be attached especially to the rear side or a lower side of the glass plate and can be visible through the glass plate.

In another form of embodiment the mask can be attached to a panel above the refrigerated goods container, especially attached to a panel connected to a shelf, especially a glass plate.

In this form of embodiment the shelf does not necessarily have to be embodied transparent. It is sufficient for the panel used to be embodied transparent. Thus the shelf can have a section into which the panel embodied as separate component is inserted. In such cases the panel can simultaneously serve as support housing for the manual actuator. Consequently the manual actuator can be prefabricated together with the panel as a pre-assembled module. The pre-assembled module can subsequently be inserted into the cutout of the shelf.

In a further form of embodiment the mask can be attached to a display wall of the actuator, especially to a front wall of the actuator, the actuator can be adjustably mounted on a support section and the support section can feature the display section in such cases.

To this end the actuator can be designed as a bracket U-shaped in its cross-section which has an upper wall and a lower wall, between which a display wall extends, aligned at right angles thereto in each case. With its bracket shaped like a U in cross-section the actuator in this form of embodiment is pushed onto a support section of the shelf or of the glass plate.

The actuator is mounted adjustably in relation to the support section in this case. The mask in this form of embodiment is attached to the display wall of the actuator. The support section of the shelf or of the glass plate then bears the display section on an end face side pointing towards the display wall of the actuator.

In all embodiments the manual actuator can have an actuation section, especially an actuation press surface and can be embodied to move the actuation section or the actuation press surface respectively back into an output position if the actuation section or the actuation press surface is released after each manual actuation. The actuation press surface can for example be a front surface of a button body, which is supported on a panel or on a frame in the inner container of the domestic refrigeration appliance. The actuation press surface can for example be disposed on a front edge of a shelf supported over the refrigerated goods container, especially a glass plate.

In the case of this form of embodiment in particular the support section can be embodied on the shelf, especially on the glass plate.

In all embodiments of the inventive domestic refrigeration appliance the display means can have an electronic display means, especially an optical display means, especially a means of illumination, which directly displays the information identifying the open position and/or the information identifying the closed position by optical illumination or shows it indirectly by lighting or backlighting a fixed graphical display.

The electronic display means, especially the optical display means, especially the means of illumination can be embodied to illuminate the mask and/or the display section or to shine through it. Such illumination and backlighting can be activated independently of the position of the actuator, i.e. can be activated permanently. As an alternative such illumination and backlighting can be undertaken as a function of the position of the actuator. This can mean that the electronic display means, especially the optical display means, especially the means of illumination, is switched on in a first position of the actuator, i.e. lights, and is switched off in a second position of the actuator, i.e. does not light. Two electronic display means, especially two optical display means, especially two means of illumination can also be provided, wherein in the first position of the actuator only the one lights or only the other lights.

In all embodiments of the inventive domestic refrigeration appliance the manual actuator can be formed by a press button switch, which in a pressed state of a first actuation surface of the press button switch moves the container lid into the open position and which in a pressed state of the second actuation surface of the press button switch moves the container lid into the closed position, wherein a coupling device connected to the press button switch is embodied, by pressing the second actuation surface, to move the first actuation service into its initial position and by pressing the second actuation surface to move the second actuation surface into its initial position.

In a first variant the manual actuator can be designed as a press button switch, i.e. can have two switching states. In this case, in a first position of the press button switch an actuation surface of the press button switch can project further than it does in a second position. In these two positions the actuation surface is punctuated, i.e. a user's finger is not touching it or pressing it. In the first position of the press button switch the container lid can be located in the first position. In the second position of the press button switch the container lid can be located in the second position. Two container lid positions can thus be realized by means of such a press button switch.

In summary and sometimes explained in a different way, a simple-to-understand display of the state, especially the humidity in a refrigerated goods container, especially in a refrigerated goods drawer, can be realized.

A glass shelf, especially with a front rail, can be located above a humidity-controlled drawer for example. The actual cover which can regulate the refrigerated goods drawer by sealing it is located below said shelf. By contrast with known simple sliders, this lid is moved by two press buttons for example. Such press buttons can be coupled to one another and guided via a mechanism. Means known to the person skilled in the art such as lever arms, parallelograms, toothed wheels, cables etc. can be used for this purpose. This means that when a button is pressed in the other button comes out at the same moment and the sealing lid changes its position. The inventively described display means are embodied to enable the two switching states, e.g. "wet" and "dry" to be able to be displayed even better.

For example a glass plate can be masked out, printed or provided with a film from below. In such cases there is no need for a typical graphic or a text which visualizes the switching states. The switch which moves below this surface has two different surfaces on its upper side which are displayed alternatively below the graphic section. Thus the graphic can be against a colored background, depending on the switching state.

Such a mechanical solution, instead of being located below a glass plate, can also be located in a display-type plastic part, e.g. in a plastic plate. Colored backing of the display graphic can also be undertaken directly in the button and can stand out there on the cover surface and/or on the front. As an alternative or in addition a mechanical solution can also be embodied with electronic displays, such as LEDs for example or other electrically illuminated graphics.

Overall a simple, clear and satisfying operation and display can be achieved. Such a solution can also have a high-quality and refined effect. A display can be simulated by low-cost highlighting technology or LEDs.

Various exemplary embodiments of the invention are shown by way of example in the enclosed schematic diagrams, in which.

Figure 9:
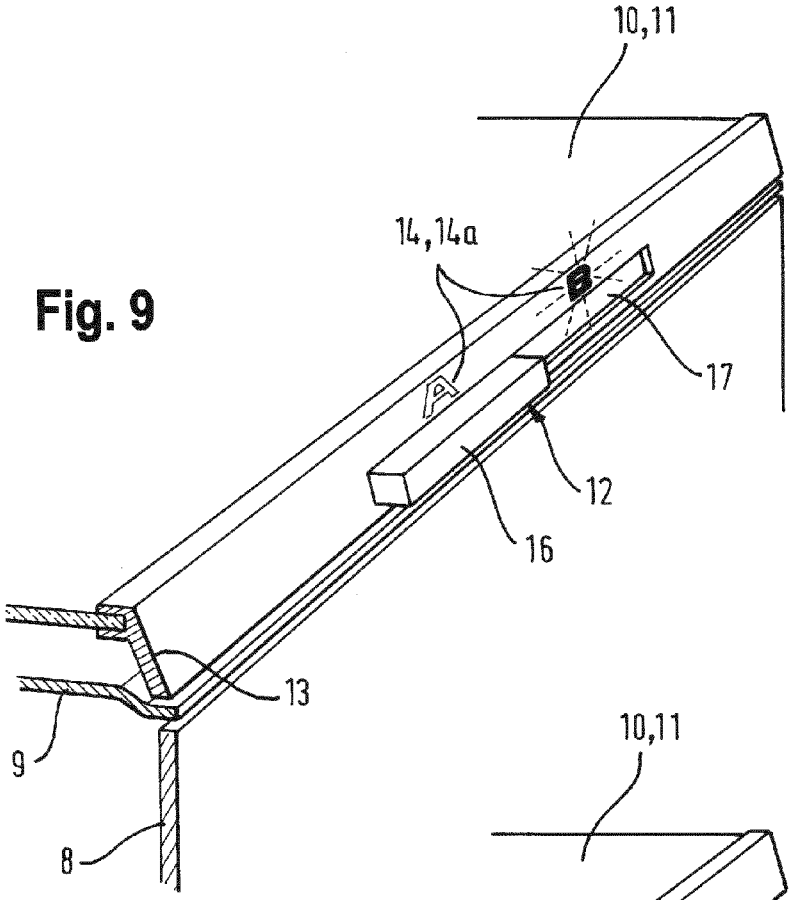
Figure 10:
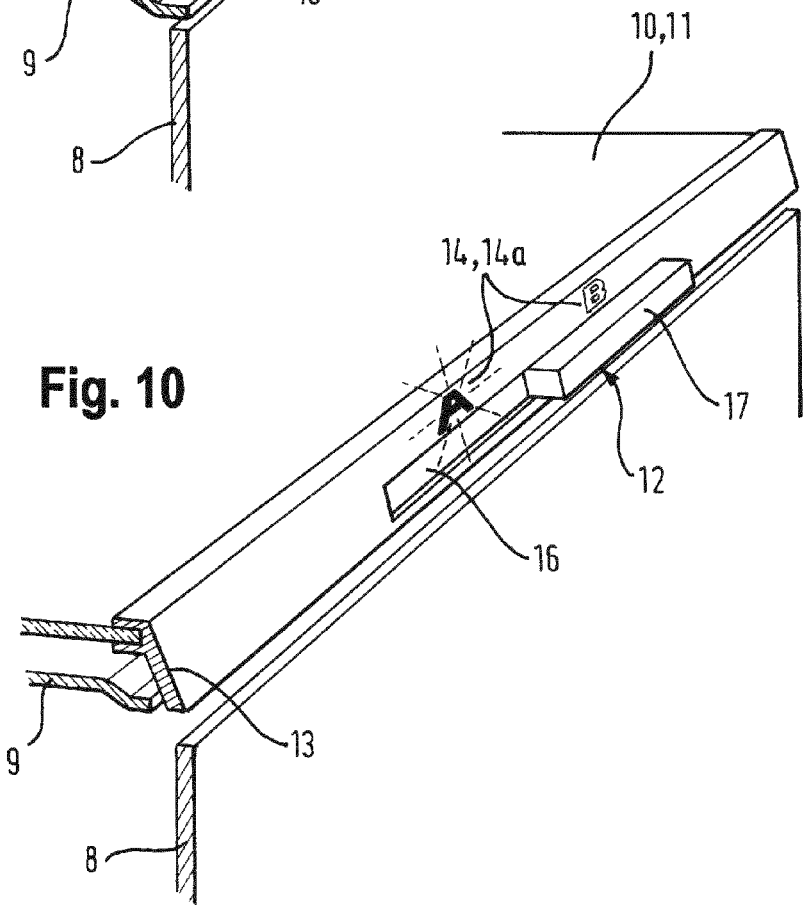

FIG. 9 shows a perspective part view of the fourth form of embodiment of a manual actuator with an electronic display means in the form of a means of illumination for an activated switch position B; and FIG. 10 shows a perspective part view of the fourth form of embodiment of the manual actuator according to FIG. 9 with an electronic display means in the form of a means of illumination for activated switch position A.

Figure 1:
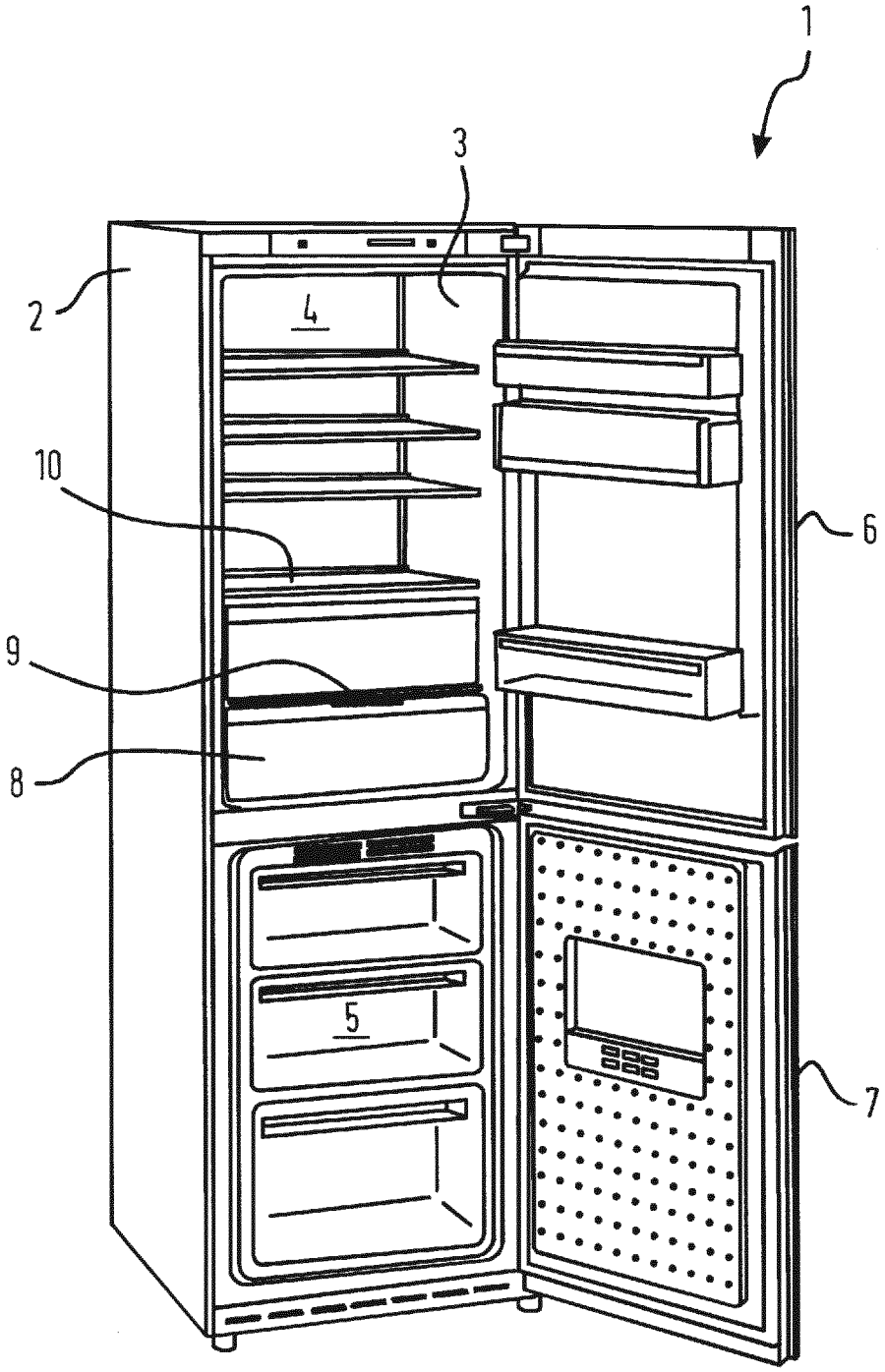
FIG. 1 shows a perspective view of a domestic refrigeration appliance with a number of refrigerated goods containers and shelves and an inventive refrigerated goods container with a container lid and manual actuator.

A domestic refrigeration appliance 1 shown by way of example in FIG. 1 has a carcass 2 with an inner container 3. In the exemplary embodiment shown the inner container 3 is divided into a refrigerator compartment 4 arranged at the top and a freezer compartment 5 arranged at the bottom. The refrigerator compartment 4 generally serves for frost-free cooling of refrigerated goods, preferably at temperatures between plus 4 and plus 8 degrees Celsius. The refrigerator compartment 4 can however also be embodied as a zero-degrees drawer, especially for keeping fruit or vegetables fresh. The refrigerator compartment 4 is accessible with the refrigerator compartment door 6 open. The freezer compartment 5 generally serves for deep freezing frozen goods at approximately −18 degrees Celsius. The freezer compartment 5 is accessible with the freezer compartment door 7 open. A typical pull-out refrigerated goods container 8, which is able to be closed off by means of a container lid 9 supported above the refrigerated goods container 8, is mounted in the refrigerator compartment 4. As shown, a shelf 10 can be mounted above the container lid 9.

Figure 2:
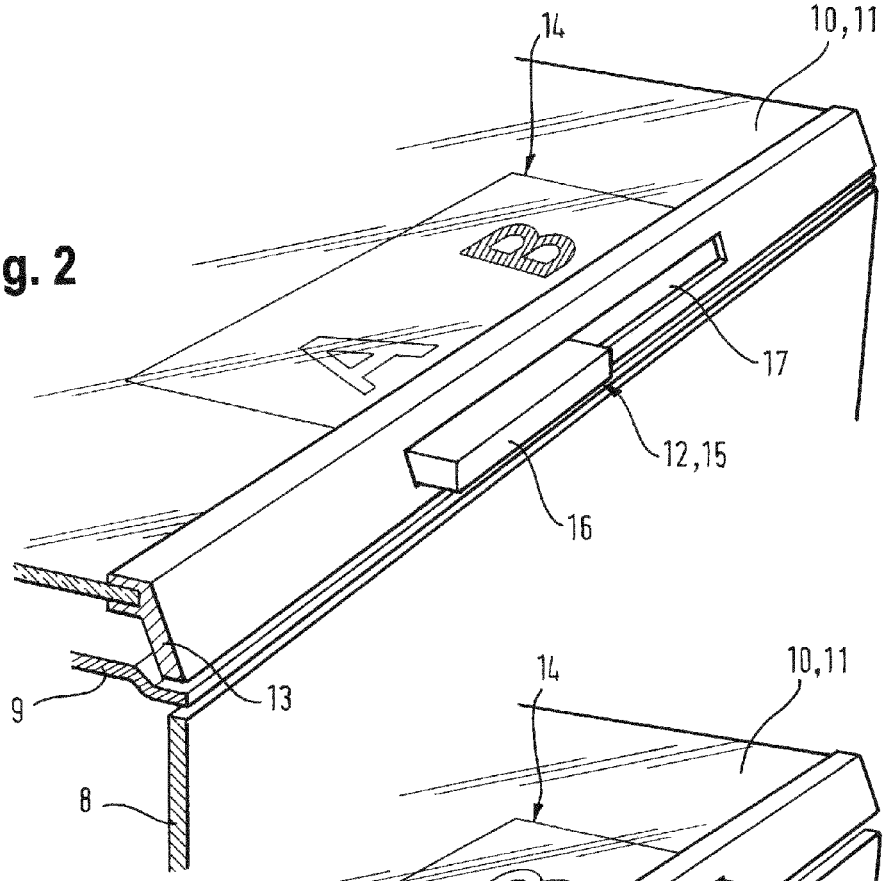
FIG. 2 shows a perspective part view of a first form of embodiment of a manual actuator with a display means in a switch position B.

FIG. 2 shows a first form of embodiment of the manual actuator 12 with a display means 14 in a switch position B. The container lid 9 is mounted above the refrigerated goods container 8 such that by moving, especially raising and lowering the container lid 9, the refrigerated goods container 8 can be opened and closed. Disposed above the container lid 9 is a shelf 10 in the form of a glass plate 11. A front panel 13 is provided on a front side of the glass plate 11. Let into the front panel 13 is a press button switch 15, which has a first actuation surface 16 and a second actuation surface 17.

Figure 3:
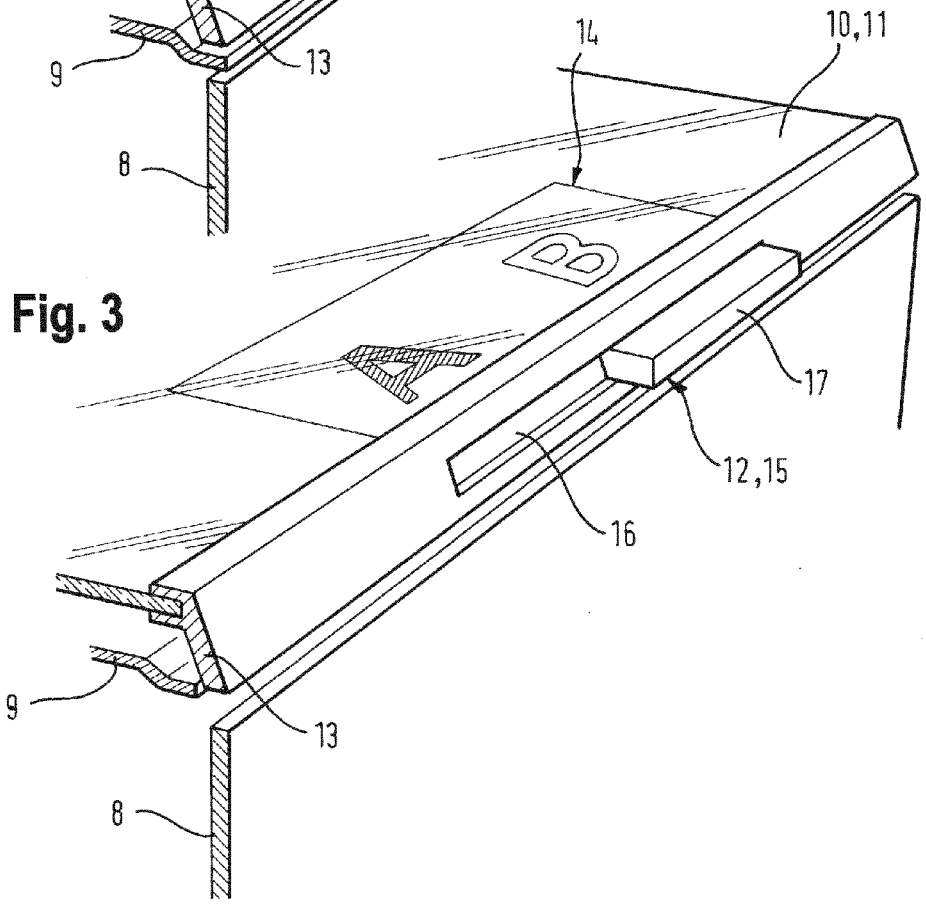
FIG. 3 shows a perspective part view of the first form of embodiment of a manual actuator according to FIG. 2 with the display means in a switch position A.

The manual actuator 12, in the form of embodiment according to FIG. 2, has a press button switch 15 which, in the pressed state of a first actuation surface 16 of the press button switch 15, moves the container lid 9 into an open position and which, in the pressed state of a second actuation surface 17 of the press button switch 15, moves the container lid 9 into the closed position, wherein a coupling device known per se to the person skilled in the art is connected to the press button switch 15 to move the first actuation surface 16 into its initial position by pressing the second actuation surface 17 and by pressing the first actuation surface 16 to move the second actuation surface 17 into its initial position, as is illustrated schematically by FIG. 2 and FIG. 3.

In the position of the container lid 9 shown in FIG. 2 the refrigerated goods container 8 is closed. In this respect the manual actuator 12 is in its second position in FIG. 2. In this position, as shown, the container lid 9 closes off the refrigerated goods container and the second actuation surface 17 is pressed, wherein the display means 14 typically shows or highlights a switch position B as information. In this case the closed lid position of the container lid 9 is clearly evident.

In the position of the container lid 9 shown in FIG. 3 the refrigerated goods container 8 is opened. In this respect the manual actuator 12 is in its first position in FIG. 3. In this position, as shown, the container lid 9 opens the refrigerated goods container and the first actuation surface 16 is pressed, wherein the display means 14 typically shows or highlights a switch position A as information. In this case the opening lid position of the container lid 9 is clearly evident.

Figure 4:
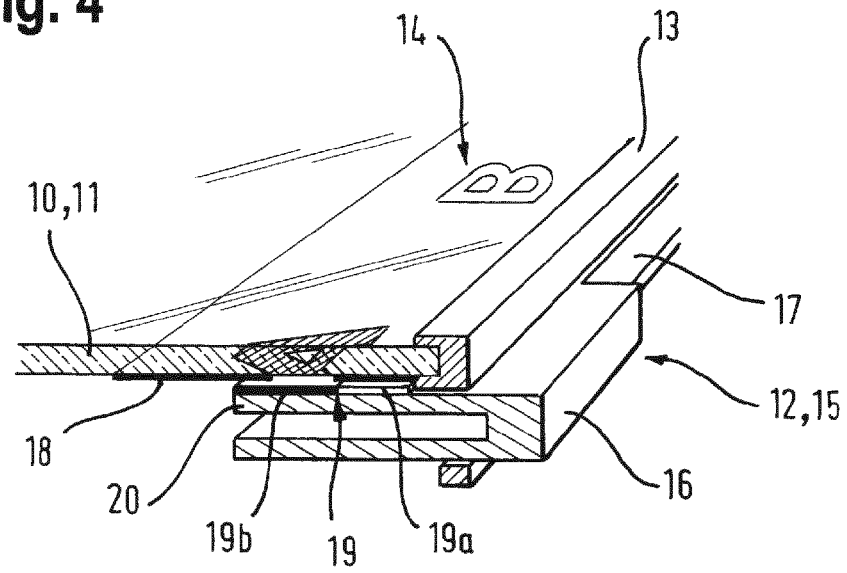
FIG. 4 shows a part cross-section through a wall section of a manual actuator which is supported below a glass shelf, with a second form of embodiment of a display means in a switch position A.

FIG. 4 shows a second form of embodiment of a manual actuator 12 with a display means 14 which has a mask 18. The mask 18 bears an item of information A, B identifying the open position or the closed position in the form of a mask cutout. The mask 18 is embodied as a film, which is glued or laminated for example onto an underside of the glass plate 11, in the case of the exemplary embodiment shown.

The first actuation surface 16 of the manual actuator 12 has a display section 19, which reveals an A as the example information in the exemplary embodiment shown, and which in the first position of the manual actuator 12 allows the information A of the mask identifying the open position to stand out optically. To this end the manual actuator 12 has a wall section 20 which is supported below the glass plate 11. Attached to the wall section 20 is the display section 19.

If the first actuation surface 16 is in the position shown in FIG. 4, a second color surface section 19*b* of the display section 19 attached to the wall section 20 comes to rest precisely below the mask section of the mask 18 so that, as a result of the colored design of the second color surface section 19*b* and of the mask 18, the information A to be displayed stands out optically. In this case for example the second color surface section 19*b* can have a color different from the mask 18, especially a high-contrast color.

Figure 5:
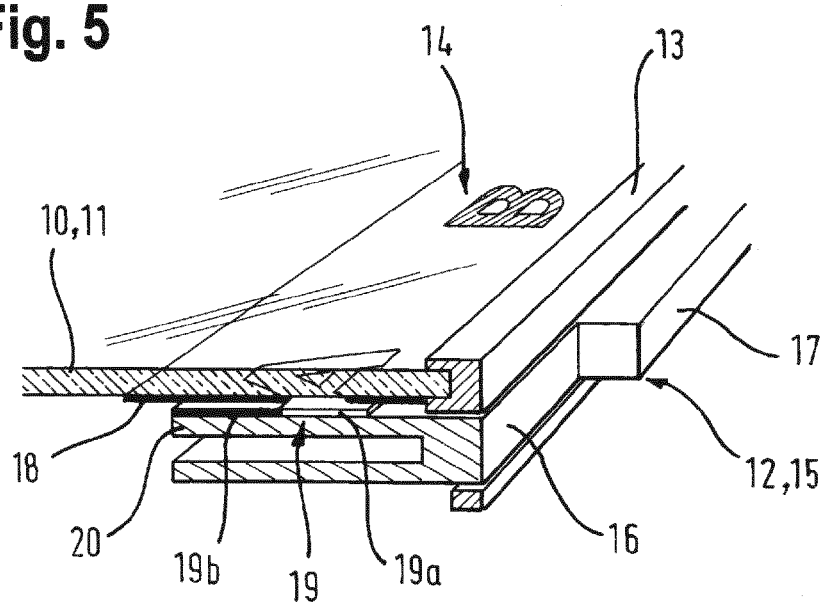
FIG. 5 shows a part cross-section through a wall section of the manual actuator according to FIG. 4, with the display means in a switch position B.

If the first actuation surface 16 is in the position shown in FIG. 5, a first color surface section 19*a* of the display section 19 attached to the wall section 20 comes to rest precisely below the mask section of the mask 18 so that, as a result of the colored design of the first color surface section 19*a* and of the mask 18, the information A does not stand out optically, i.e. recedes optically. In this case for example the first color surface section 19*a* can have the same color and/or the same contrast as the mask 18.

Figure 6:
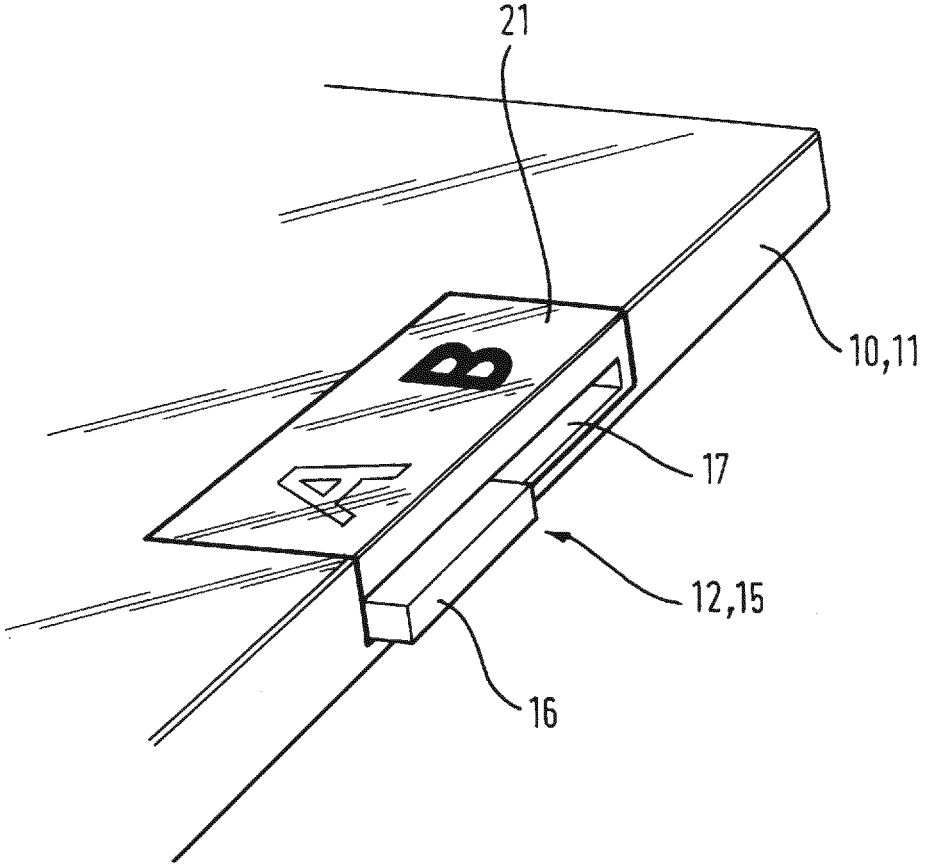
FIG. 6 shows a perspective part view of a second form of embodiment of the manual actuator with the display means in the form of a panel attached to a shelf.

FIG. 6 shows an alternate form of embodiment of a manual actuator 12 with a display means 14, in the form of a separate panel 21 attached to the shelf 10. In this form of embodiment the shelf then does not necessarily have to be embodied transparent. It is sufficient for the inserted panel 21 to be embodied transparent. Thus the shelf 10, as shown, can have a cutout into which the panel 21 embodied as a separate component is inserted. In this case the panel 21 can simultaneously serve as the support housing for the manual actuator 12. Consequently the manual actuator 12 can be prefabricated together with the panel 21 as a pre-installed module. The pre-installed module can subsequently be inserted into the cutout of the shelf 10.

Figure 7:
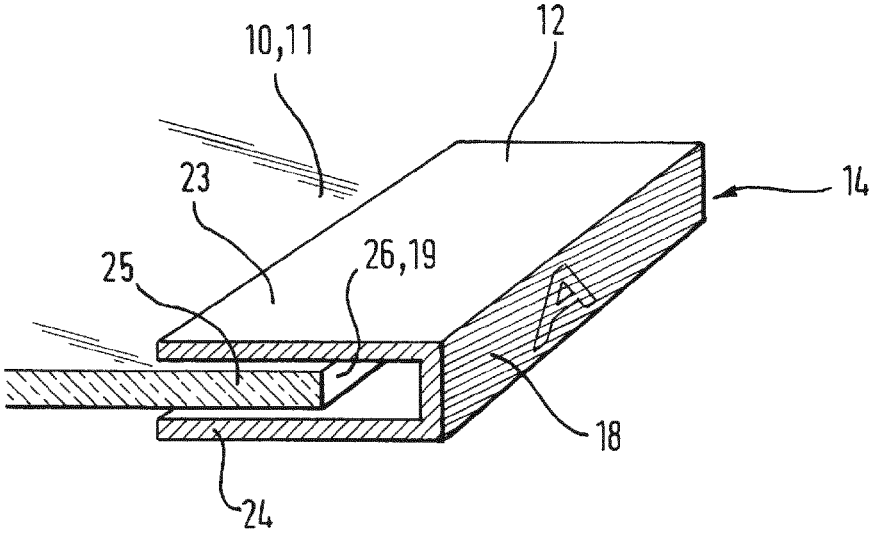
FIG. 7 shows a perspective part cross-section view through a third form of embodiment of a manual actuator with a display means in which the mask is attached to a display wall of the actuator, wherein the actuator is adjustably supported in relation to a support section, in a deactivated switch position A.

FIG. 7 shows a third form of embodiment of a manual actuator 12 with a display means 14 in which the mask 18 is attached to a display wall 22 of the actuator 12. In the exemplary embodiment shown the actuator 12 is designed as a bracket with a U-shaped cross-section which has an upper wall 23 and a lower wall 24 between which in each case, aligned at right angles thereto, the display wall 22 extends. With its bracket in the shape of a U in cross-section the actuator 12 is pushed onto a support section 25 of the shelf 10 or of the glass plate 11.

In this case the actuator 12 is adjustably mounted in relation to the support section 25. The mask 18 in this form of embodiment is attached to the display wall 22 of the actuator 12. The support section 25 of the shelf 10 or of the glass plate 11 bears the display section 19 on an end face side 26 pointing towards the display wall 22 of the actuator 12.

In the position of the actuator 12 shown in FIG. 7, the mask 18 of the actuator 12 is positioned at a clear distance from the display section 19 on the end face side 26 of the support section 25 of the shelf 10 or of the glass plate 11, so that the mask cutout A is dark and the information to this extent does not stand out but optically recedes or even remains hidden.

Figure 8:
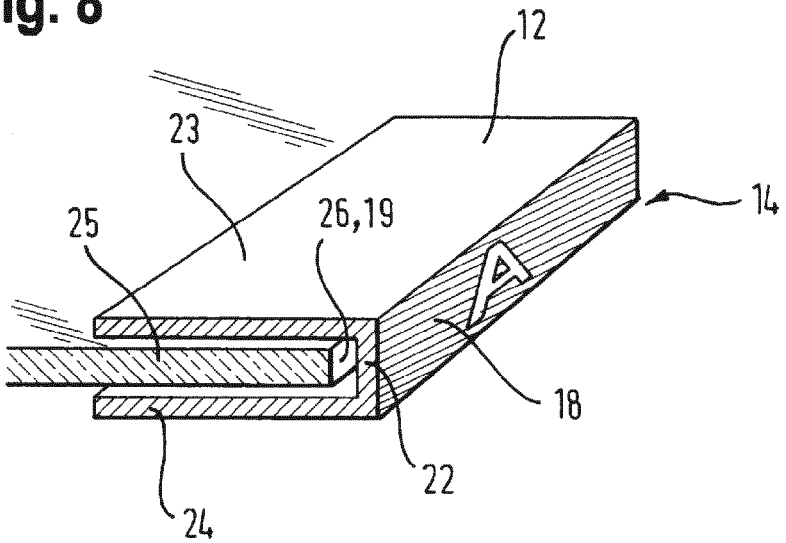
FIG. 8 shows a perspective part cross-sectional view through the third form of embodiment according to FIG. 7 for an activated switch position A.

In the position of the actuator 12 shown in FIG. 8 the mask 18 of the actuator 12 by contrast is positioned directly in front of the display section 19 on the end face side 26 of the support section 25 of the shelf 10 or of the glass plate 11, so that the mask cutout A is bright or stands out in color and is thus easy to see.

In a fourth form of embodiment shown in FIG. 9 the manual actuator 12 is embodied with an electronic display means 14 in the form of a means of illumination 14*a*, as shown schematically in FIG. 10, which indicates the information A identifying the open position and/or, as indicated schematically in FIG. 9, the information B identifying the closed position, by direct optical illumination.

LIST OF REFERENCE CHARACTERS

1 Domestic refrigeration appliance
2 Carcass
3 Inner container
4 Fridge compartment
5 Freezer compartment
6 Fridge compartment door
7 Freezer compartment door
8 Refrigerated goods container
9 Container lid
10 Shelf
11 Glass plate
12 Manual actuator
13 Front panel
14 Display means
14*a* Illumination means
15 Press button
16 First actuation surface
17 Second actuation surface
18 Mask
19 Display section
19*a* First color surface section
19*b* Second color surface section
20 Wall section
21 Panel
22 Display wall
23 Upper wall
24 Lower wall
25 Support section
26 End face side

The invention claimed is:

1. A domestic refrigeration appliance, having a heat-insulating inner container, which is embodied to delimit at least one storage space for refrigerated goods, a refrigerated goods container supported in the inner container to, and moving in substantially horizontal backward and forward directions between retracted and extended positions, the container having an opening accessible from a top of the container and a container lid which is mounted in the inner container such that movement executed in the substantially horizontal direction by a manual actuator is converted into movement of the container lid for opening and closing the opening of the refrigerated goods container, wherein a display coupled to the actuator which is embodied, in a first position of the actuator, in which the container lid is moved into a lid position opening the opening of the refrigerated goods container, to display information indicating the open position and in a second position of the actuator, in which the container lid is moved into a lid position closing the opening of the refrigerated goods container, to display information identifying the closed position, wherein the manual actuator includes first and second press buttons, wherein the first and second press buttons move in opposite directions when one of the first and second press buttons is pressed in the substantially horizontal backward direction, wherein when the first button is pressed in the substantially horizontal backward direction to open the container lid the second button is caused to protrude in the substantially horizontal forward direction relative to the first button, and wherein when the second button is pressed in the substantially horizontal backward direction to close the container lid, the first button is caused to protrude in the substantially horizontal forward direction relative to the second button.

2. The domestic refrigeration appliance as claimed in claim 1, wherein the display has a mask which bears the information identifying the open position and/or the closed position in the form of a mask cutout, and the display, has a display section which in the first position of the actuator makes the information of the mask identifying the open position stand out optically and/or in the second position of the actuator, makes the information of the mask identifying the closed position stand out optically.

3. The domestic refrigeration appliance as claimed in claim 2, wherein the actuator has a display section which, in the first position of the actuator makes the information of the mask identifying the closed position recede optically and/or in the second position of the actuator, makes the information of the mask identifying the open position recede optically.

4. The domestic refrigeration appliance as claimed in claim 2, wherein the display section has a first colored surface section at least approximately matching the mask, and a second colored surface section which differs in color from the mask.

5. The domestic refrigeration appliance as claimed in claim 2, wherein the mask is attached to a transparent shelf disposed above the refrigerated goods container.

6. The domestic refrigeration appliance as claimed in claim 2, wherein the mask is attached to a panel disposed above the refrigerated goods container.

7. The domestic refrigeration appliance as claimed in claim 2, wherein the mask is attached to a display wall of the actuator, the actuator is mounted adjustably on a support section, and the support section features the display section.

8. The domestic refrigeration appliance as claimed in claim 7, wherein the support section is embodied on a shelf.

9. The domestic refrigeration appliance as claimed in claim 1, wherein the display has an electronic display which displays the information identifying the open position and/or the information identifying the closed position as direct optical illumination or indirectly via lighting or backlighting of a fixed graphical display.

10. The domestic refrigeration appliance as claimed in claim 1, wherein the press buttons are comprised in a press button switch which in a pressed state of the first press button, moves the container lid into the open position and which in a pressed state of the second press button, moves the container lid into the closed position, wherein a coupling device connected to between the press buttons is embodied, by pressing the second press button, to move the first press button into an initial position of the first press button and by pressing the first press button, to move the second button into an initial position of the second button.

11. The domestic refrigeration appliance as claimed in claim 1, wherein the manual actuator is movable between a retracted position corresponding to an open position of the lid and an extended position corresponding to a closed position of the lid.

12. The domestic refrigeration appliance as claimed in claim 1, wherein the display includes a first section bearing information identifying the open position and a second section bearing information identifying the closed position, wherein, in the first position of the actuator, the information identifying the open position on the first section of the display is revealed to stand out optically and the information identifying the closed position on the second section of the display is hidden to not stand out optically, and wherein, in the second position of the actuator, the information identifying the closed position on the second section of the display is revealed to stand out optically and the information identifying the open position on the second section of the display is hidden to not stand out optically.

* * * * *